US007757908B1

(12) United States Patent
Buhl, Jr.

(10) Patent No.: US 7,757,908 B1
(45) Date of Patent: Jul. 20, 2010

(54) PORTABLE CONTAINER AND DISPENSER FOR KEGGED BEER

(76) Inventor: Thomas R. Buhl, Jr., 8612 Via Del Luz, El Cajon, CA (US) 92021

( * ) Notice: Subject to any disclaimer, the term of this patent is extended or adjusted under 35 U.S.C. 154(b) by 1407 days.

(21) Appl. No.: 11/150,657

(22) Filed: Jun. 13, 2005

(51) Int. Cl.
*B67D 7/80* (2010.01)

(52) U.S. Cl. ..... 222/608; 222/146.6; 222/183; 222/399; 141/231; 62/239

(58) Field of Classification Search ..... 222/182, 222/183, 399, 608, 628, 146.6, 131; 141/231; 62/239, 306, 400, 465
See application file for complete search history.

(56) References Cited

U.S. PATENT DOCUMENTS

| | | | | | |
|---|---|---|---|---|---|
| 488,144 | A | * | 12/1892 | Gibson | 165/132 |
| 1,979,549 | A | * | 11/1934 | Huckel | 62/462 |
| 2,003,050 | A | * | 5/1935 | Iselin | 222/131 |
| 2,917,906 | A | | 12/1959 | Woolley | |
| 4,544,173 | A | | 10/1985 | Kellermyer | |
| D312,524 | S | | 11/1990 | Juergens | |
| 5,154,317 | A | * | 10/1992 | Roppolo, III | 222/66 |
| 5,282,561 | A | | 2/1994 | Mihalich | |
| 5,454,477 | A | * | 10/1995 | Bornhorst et al. | 220/23.4 |
| 6,010,043 | A | * | 1/2000 | Williamson et al. | 222/608 |
| 6,328,320 | B1 | | 12/2001 | Walski et al. | |
| 6,454,131 | B1 | * | 9/2002 | Van Der Meer et al. | 222/95 |
| 6,637,224 | B2 | | 10/2003 | Chiusolo | |
| 2006/0011664 | A1 | * | 1/2006 | Hammond | 222/399 |

* cited by examiner

*Primary Examiner*—J. Casimer Jacyna

(57) ABSTRACT

A combination beer container and dispenser includes an outer container having a top section provided with an opening centrally formed therein. The top section includes a removable lid selectively positional in the opening. The outer container further has front and rear sections and includes a plurality of flange portions extending inwardly and orthogonally from the front and rear sections. An inner container having a cylindrical shape defines a cavity therein. A mechanism for dispensing beer from the keg and a mechanism for securing the keg within the inner container are also included. An axle having opposed end portions is positioned in a bore. A drain cock is directly conjoined to the rear and is manually adaptable between open and closed positions. A plurality of wheels are conjoined to the end portions of the axle. Such wheels include coextensive and juxtaposed ridges for providing traction.

5 Claims, 7 Drawing Sheets

PORTABLE CONTAINER AND DISPENSER FOR KEGGED BEER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to beverage dispensers and, more particularly, to a portable container and dispenser for kegged beer.

2. Prior Art

The most typical manner to provide cool beverages at remote locations is to transport canned beverages in coolers containing ice and distribute the canned beverages at the remote location. However, the use of canned beverages is more costly to the consumer and creates significant waste in the form of emptied cans. Further, the use of individual cans reduces the volume of beverage one is able to transport to such remote locations since the can packaging occupies the limited cooler space.

To address the problems associated with canned beverages there have been attempts to use kegs or other such large vessels to distribute cool beverages at remote locations. However, this method also has drawbacks. It is difficult to cool large vessels so that the beverages are of an acceptable temperature. Further, portable containers are often subject to severe agitation when they are traveling over hilly or rough terrain such as golf courses. A combination of elevated temperature and agitation causes the beverages to form foam. If the beverage is beer, the beer which discharges from the container will be in the form of foam. This ruins the taste of the beverage and makes it impossible to pour the beer properly due to excess foaming.

Since most beverages enjoyed by consumers are carbonated, minimizing foaming is of critical importance. When gas that is dissolved in a carbonated beverage leaves the liquid, it creates foam. The foam is often waste and is poured off before the beverage is served. If a carbonated beverage is not handled properly, 50% can be lost to foam waste. Further, even that portion of the carbonated beverage that does not foam will likely be of poor quality since the loss of carbonation will make the beverage less acidic or "flat".

Because the solubility of a gas in a liquid is higher at lower temperatures, the carbon dioxide gas is less likely to come out of solution and form foam at cooler temperatures. Accordingly, it is desirable to dispense carbonated beverages at cool temperatures. Another means to minimize foaming is to maintain the carbonated beverage under a certain amount of pressure. This is true because the solubility of a gas in a liquid is higher at elevated pressures. When the pressure on a carbonated beverage is released or reduced the gas dissolved therein leaves solution more readily and creates foam.

Pressure can be maintained on carbonated beverages up to the point of dispensing it by forcing the beverage through a length of conduit of a lesser diameter than the conduit from which it was dispensed from the holding vessel. A significant portion of foam which is present at the time the carbonated beverage is dispensed from the vessel will be reabsorbed by the carbonated beverage by the time it is dispensed for the consumer.

However, neither the cooling nor pressurization of the carbonated beverage alone is sufficient to satisfactorily reduce foam. The prior art does not describe an apparatus or process, of a portable nature, which provides for the dispensing of cooled, non-foamed carbonated beverages in an economical manner.

Accordingly, a need remains for a portable apparatus that dispenses cooled, carbonated beverages such as beer. The present invention satisfies such a need by providing a portable container and dispenser for kegged beer. Such an invention is durable, convenient and can be easily transported to remote locations. The insulated design minimizes the need for ice, decreasing the weight to be transported and reducing the amount of excess fluids to be drained.

BRIEF SUMMARY OF THE INVENTION

In view of the foregoing background, it is therefore an object of the present invention to provide a portable container and dispenser for kegged beer. These and other objects, features, and advantages of the invention are provided by an outer container having a top section provided with an opening centrally formed therein. The top section includes a removable lid selectively positional in the opening. The outer container further has front and rear sections and includes a plurality of flange portions extending inwardly and orthogonally from the front and rear sections. The flange portions have a bore formed therein and the rear section has a plurality of oppositely spaced and monolithically formed handle portions. The handle portions include a rectilinear handle bar positioned medially therebetween.

The present invention further includes an inner container having a cylindrical shape defining a cavity therein. Such an inner container is centrally positioned within the outer container and sized and shaped for receiving and storing a keg of beer therein. The inner container is removably positional on a bottom section of the outer container. The bottom section has a substantially planar upper surface and an axial bore formed in a rear portion thereof. The bore extending parallel to a latitudinal axis of the container.

The present invention further includes a mechanism for dispensing beer from the keg and a mechanism for securing the keg within the inner container. A rectilinear and elongated axle having opposed end portions is positioned in the bore. Such end portions extending outwardly from the bore. A drain cock is directly conjoined to the rear section and is in fluid communication therewith such that excess fluid can be manually and selectively drained from the outer container. The drain cock is manually adaptable between open and closed positions. A plurality of wheels are directly and rotatably conjoined to the end portions of the axle. Such wheels preferably include a plurality of coextensive and juxtaposed ridges for providing traction when a user traverses a ground surface.

The dispensing mechanism includes a cylinder containing a predetermined volume of pressurized carbon dioxide gas and a tap for manually and selectively dispensing beer. Such a tap includes a central body directly connected to the front section and a handle portion directly and pivotally connected to the body and extending vertically therefrom wherein a user pivots the handle portion forwardly to dispense beer and pivots the handle rearwardly to the vertical position when finished dispensing beer.

A first conduit is directly and removably connected to the cylinder and is in fluid communication with the keg such that carbon dioxide gas is caused to exit the cylinder and enter the keg when the handle portion is pivoted forwardly. Such carbon dioxide gas adds carbonation to the beer. A dual gauge regulator is directly connected to the cylinder for displaying the carbon dioxide gas pressure and the amount of gas remaining in the cylinder. A second conduit is directly and removably connected to the body of the tap and is in fluid communication with the keg wherein the beer is caused to exit the keg and is channeled through the second conduit. The beer exits the container via the tap when the handle portion is pivoted forwardly.

The securing mechanism preferably includes a plurality of locking plates each having at least one aperture formed therethrough and a plurality of fastening members removably and threadably securing the locking plates to the flange portions wherein the locking plates extend horizontally from the flange portions and engage an upper portion of the keg for maintaining the keg at a substantially stable position during operating conditions.

The bottom section of the outer container may further include a monolithically formed leg portion extending downward and orthogonal from the bottom section of the outer container. Such a leg portion provides support and stability when the container is at rest. The outer container is pivotal about a latitudinal axis such that the leg member is elevated from a ground surface during transportation of the container.

The lid preferably includes a notch centrally formed therein. Such a notch preferably includes a lip portion extending to a point medial of the notch. Such a lip portion is grasped by a user during operating conditions to assist in removing and replacing the lid during cleaning procedures. The front section may have a laterally offset and monolithically formed upper portion such that the tap can readily dispense beer into a vessel positioned therebelow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
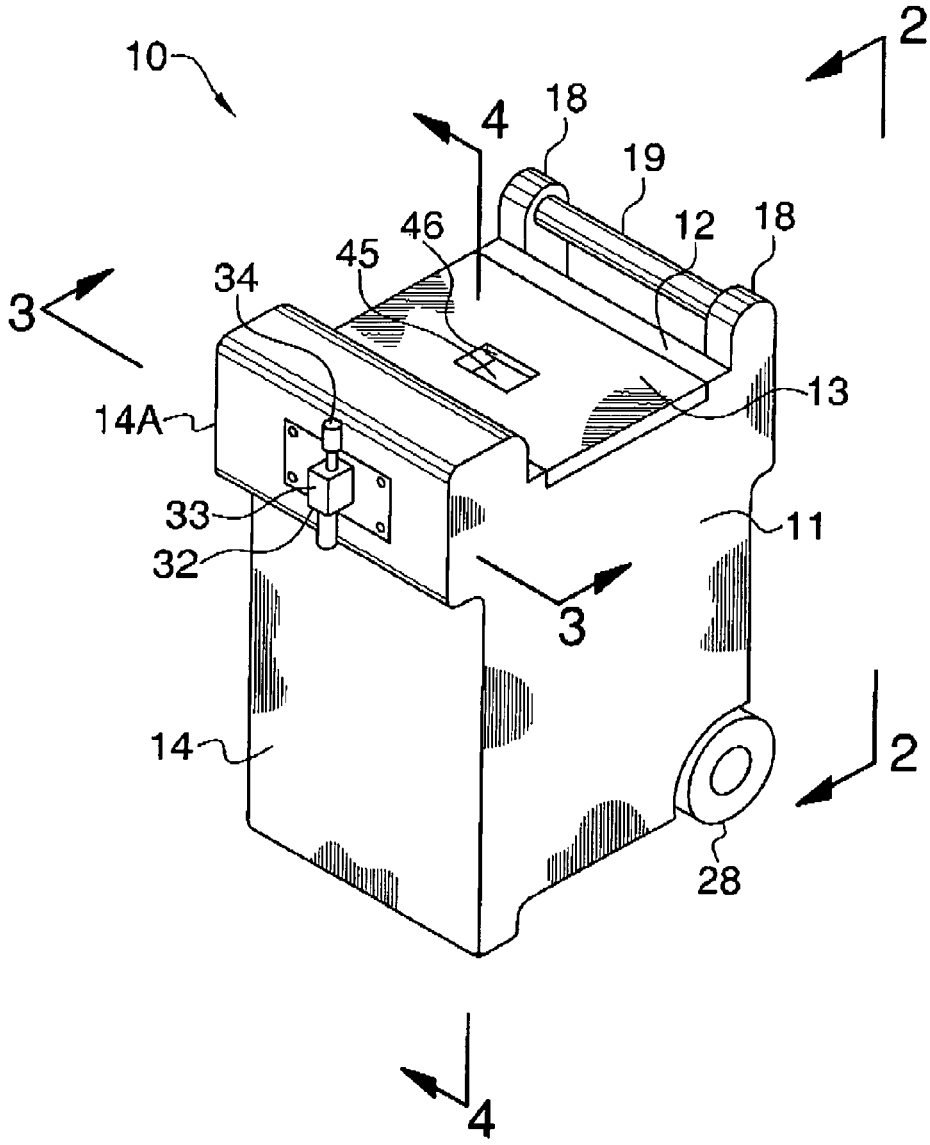
FIG. 1 is a perspective view showing a portable container and dispenser for kegged beer, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7 by the reference numeral 10 and is intended to provide a container and dispenser for kegged beer. It should be understood that the container 10 may be used to contain and dispense many different types of fluids.

Figure 2:
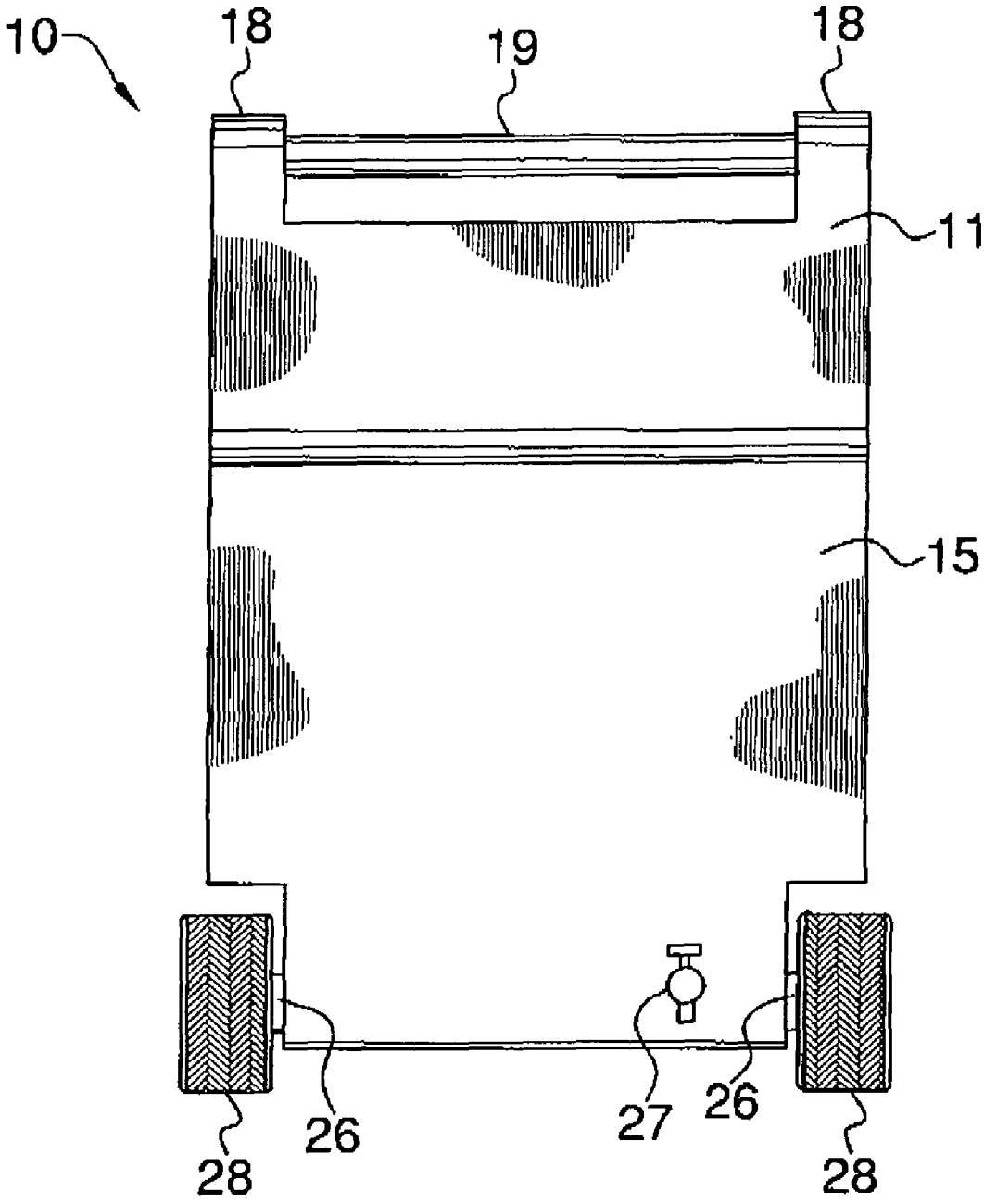
FIG. 2 is a rear elevational view of the apparatus shown in FIG. 1.
Figure 3:
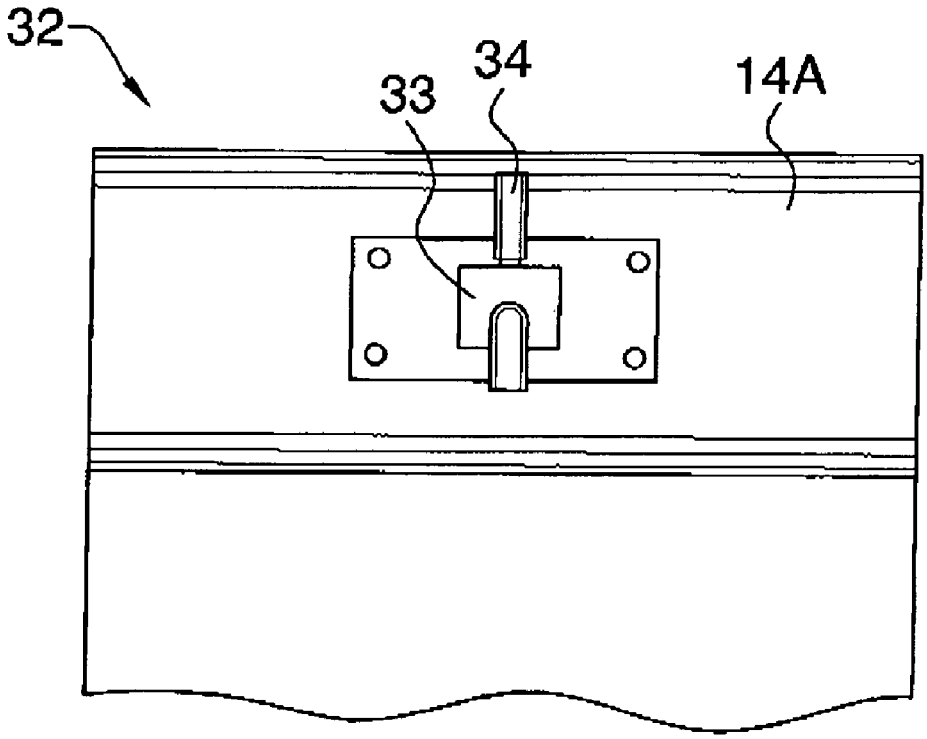
FIG. 3 is an enlarged front elevational view of the tap.
Figure 4:
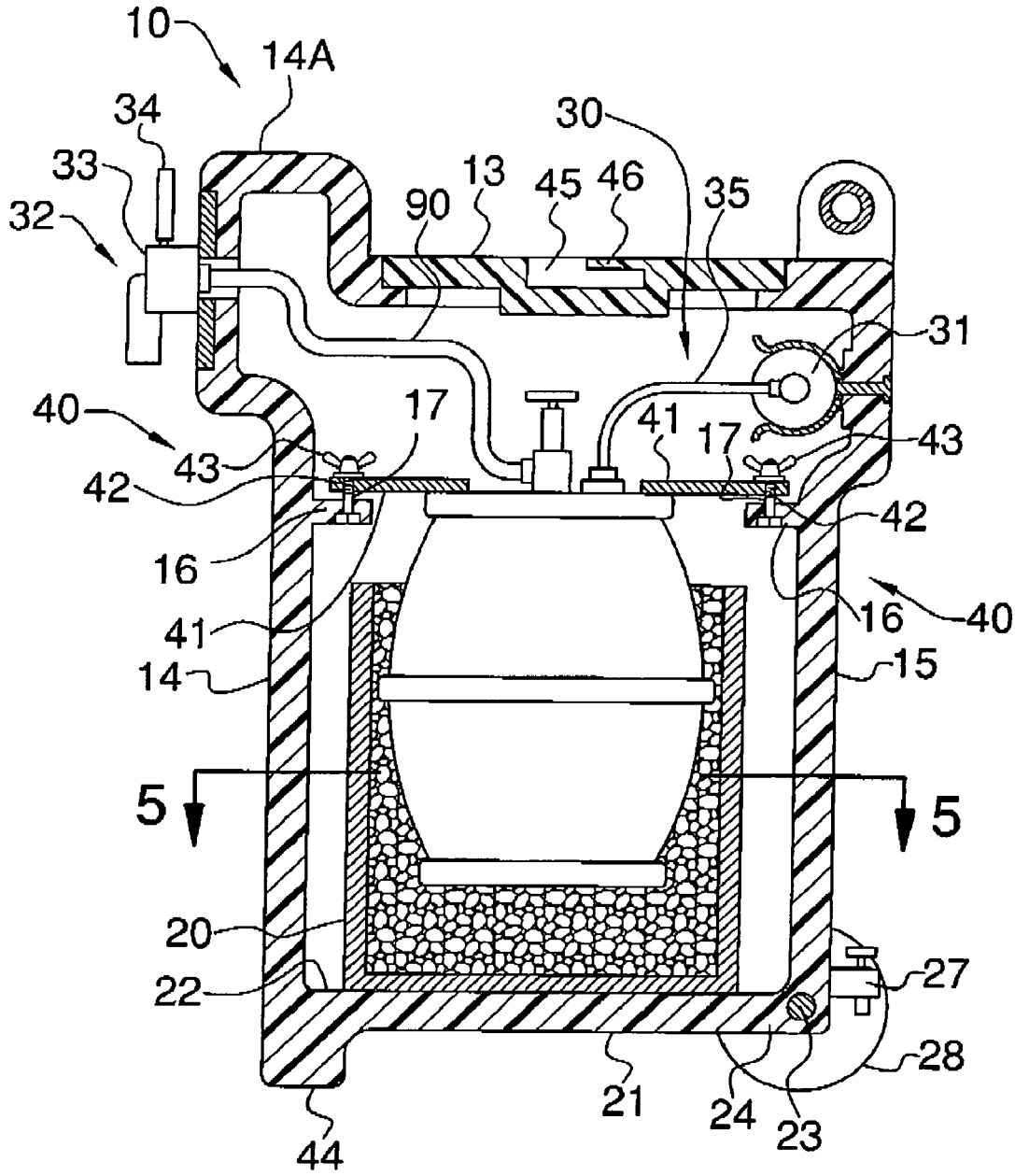
FIG. 4 is a cross-sectional view of the apparatus shown in FIG. 1, taken along line 4-4.

Initially referring to FIGS. 1, 2, and 4, the container 10 includes an outer container 11 having a top section 12 provided with an opening centrally formed therein. The top section 12 includes a removable lid 13 selectively positional in the opening. Such a lid 13 enables a user to quickly and easily access the inner container (described herein below) to remove and replace kegs. Such a feature is critical to the operation of the container 10 because access is easily gained, allowing constant monitoring of the keg.

The outer container 11 further has front 14 and rear 15 sections and includes a plurality of flange portions 16 extending inwardly and orthogonally from the front 14 and rear 15 sections. The flange portions 16 have a bore 17 formed therein and the rear section 15 has a plurality of oppositely spaced and monolithically formed handle portions 18. The handle portions 18 include a rectilinear handle bar 19 positioned medially therebetween.

Such a handle portion 18 is essential and advantageous because it enables a user to firmly grasp and easily transport the container 10 to remote locations. The inner 20 and outer 11 containers are preferably formed from durable plastic material because of its light weight and strength, but may be formed from other materials such as aluminum or wood, as is obvious to one having ordinary skill in the art.

Figure 5:
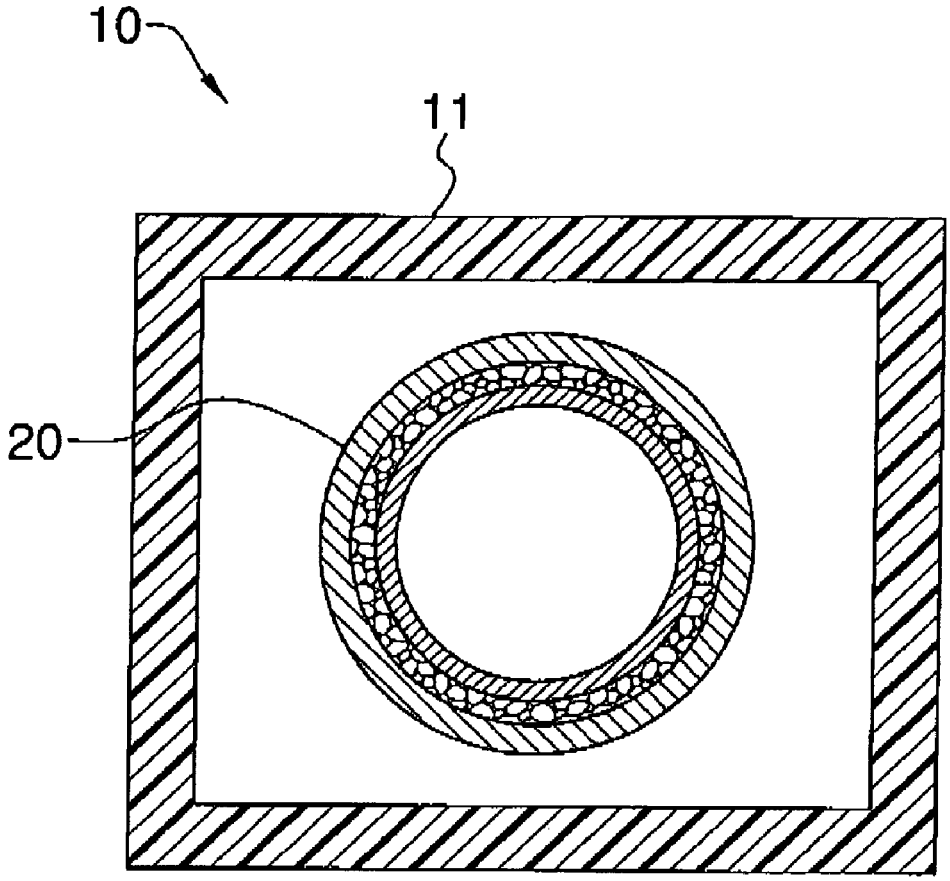
FIG. 5 is a cross-sectional view of the apparatus shown in FIG. 4, taken along line 5-5.

Referring to FIGS. 4 and 5, the present invention 10 further includes an inner container 20 having a cylindrical shape defining a cavity therein. Such an inner container 20 is centrally positioned within the outer container 11 and is sized and shaped for receiving and storing a keg of beer therein. The inner container 20 is removably positional on a bottom section 21 of the outer container 11.

The space between the inner container 20 and outer container 11 is preferably filled with insulating foam because of its insulating properties, as well known in the industry. Such insulating foam minimizes the need for ice, reducing costs and weight. The bottom section 21 has a substantially planar upper surface 22 and an axial bore 23 formed in a rear portion 24 thereof. The bore 23 extends parallel to a latitudinal axis of the container 10.

Figure 6:
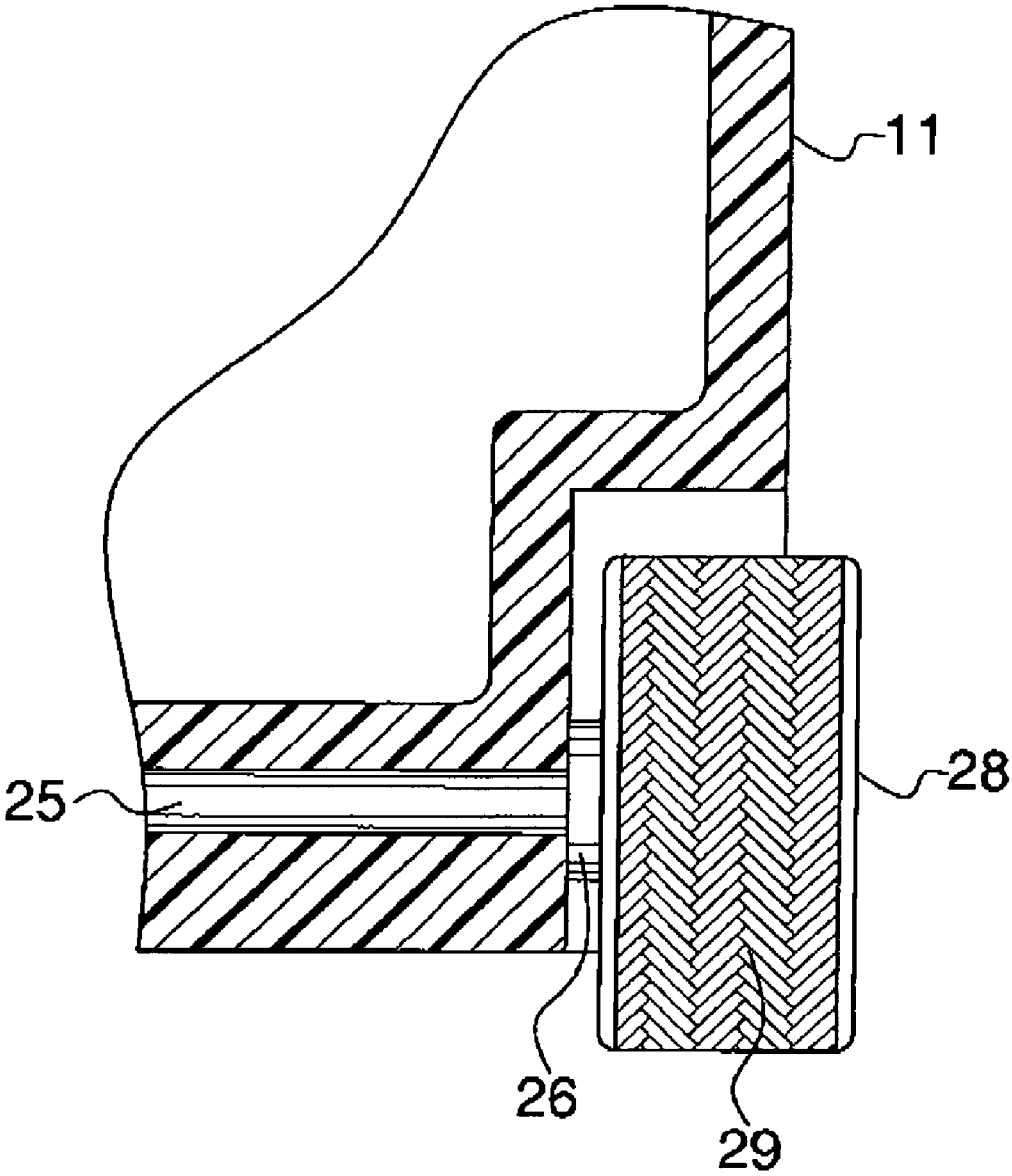
FIG. 6 is an enlarged partial cross-sectional view of the rear section showing the axle connected to a wheel.

Referring to FIGS. 2, 4 and 6, the present invention 10 further includes a mechanism 30 for dispensing beer from the keg and a mechanism 40 for securing the keg within the inner container 20. A rectilinear and elongated axle 25 having opposed end portions 26 is positioned in the bore 23. Such end portions 26 extending outwardly from the bore 23. A drain cock 27 is directly conjoined to the rear section 15 and is in fluid communication therewith such that excess fluid can be manually and selectively drained from the outer container 11.

The drain cock 27 is important to the operation of the container 10 because it efficiently allows excess fluid from spills and melted ice to be quickly and selectively drained. The drain cock 27 is manually adaptable between open and closed positions. A plurality of wheels 28 are directly and rotatably conjoined to the end portions 26 of the axle 25. Such wheels 28 include a plurality of coextensive and juxtaposed ridges 29 for providing traction when a user traverses a ground surface, as best shown in FIG. 6. Such wheels 28 are essential to transporting the container 10 across various grades of terrain, enabling a user to transport the container 10 to outdoor activities and parties, such as picnics, camping excursions, tailgate parties, outdoor concerts, and other social activities.

Figure 7:
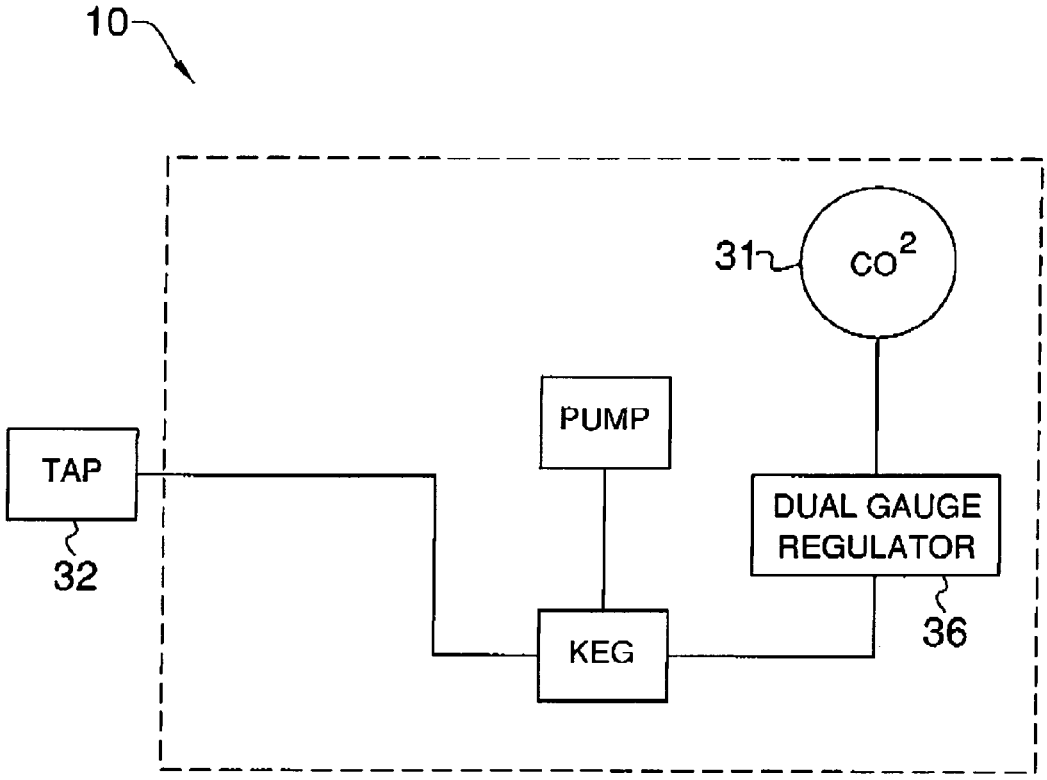
FIG. 7 is a schematic block diagram of the dispensing mechanism.

Referring to FIGS. 4 and 7, the dispensing mechanism 30 includes a cylinder 31 containing a predetermined volume of pressurized carbon dioxide gas and a tap 32 for manually and selectively dispensing beer. Such carbon dioxide gas is critical because it helps prevent the beer from becoming stale and eliminates the need for manual hand pumping of the keg. Such a manual pump, as well known in the industry, is disclosed in FIG. 4, and is shown because manual pumping may be necessary in the event the carbon dioxide gas in the cylinder 31 is exhausted, or such cylinder 31 suffers a malfunction that prevents the gas from flowing to the keg. Such a tap 32 includes a central body 33 directly connected to the front section 14 and a handle portion 34 directly and pivotally connected to the body 33 and extending vertically therefrom wherein a user pivots the handle portion 34 forwardly to dispense beer and pivots the handle portion 34 rearwardly to the vertical position when finished dispensing beer.

Still referring to FIG. 4, a first conduit 35 is directly and removably connected to the cylinder 31 and is in fluid communication with the keg such that carbon dioxide gas is caused to exit the cylinder 31 and enter the keg when the handle portion 34 is pivoted forwardly. Such carbon dioxide gas adds carbonation to the beer. A dual gauge regulator 36 is directly connected to the cylinder 31 for displaying the carbon dioxide gas pressure and the amount of gas remaining in the cylinder 31. A second conduit 90 is directly and removably connected to the body 33 of the tap 32 and is in fluid communication with the keg wherein the beer is caused to exit the keg and is channeled through the second conduit 90. The beer exits the container via the tap 32 when the handle portion 34 is pivoted forwardly.

Still referring to FIG. 4, the securing mechanism 40 includes a plurality of locking plates 41 each having at least one aperture 42 formed therethrough and a plurality of fastening members 43 removably and threadably securing the locking plates 41 to the flange portions 16 wherein the locking plates 41 extend horizontally from the flange portions 16 and engage an upper portion of the keg for maintaining the keg at a substantially stable position during operating conditions. Such locking plates 41 are essential for preventing the beer from becoming foamed during transportation.

Referring to FIGS. 1 and 4, the bottom section 21 of the outer container 11 further includes a monolithically formed leg portion 44 extending downward and orthogonal from the bottom section 21 of the outer container 11. Such a leg portion 44 provides support and stability when the container 10 is at rest. The outer container 11 is pivotal about a latitudinal axis such that the leg portion 44 is elevated from a ground surface during transportation of the container 10. Such a leg portion is critical for maintaining the bottom section 21 at a horizontal position so the keg can be fully dispensed.

Referring to FIGS. 1 and 4, the lid 13 includes a notch 45 centrally formed therein. Such a notch 45 includes a lip portion 46 extending to a point medial of the notch 45. Such a lip portion 46 is grasped by a user during operating conditions to assist in removing and replacing the lid 13 during cleaning procedures. The front section 14 has a laterally offset and monolithically formed upper portion 14A such that the tap can readily dispense beer into a vessel positioned therebelow.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable container and dispenser for kegged beer, said container comprising:

an outer container having top section provided with an opening centrally formed therein, said opening spanning across a major width of said top section, said top section including a removable lid selectively positional in the opening, said outer container further having front and rear sections, said outer container including a plurality of flange portions extending inwardly and orthogonally from said front and rear sections, said flange portions having a bore formed therein, said rear section having a plurality of oppositely spaced and monolithically formed handle portions, said handle portions including a rectilinear handle bar positioned medially therebetween;

an inner container having a cylindrical shape defining a cavity therein, said inner container being centrally positioned within said outer container and sized and shaped for receiving and storing a keg of beer therein, said inner container being removably positional on a bottom section of said outer container, said bottom section having a substantially planar upper surface, said bottom section further having an axial bore formed in a rear portion thereof, the bore extending parallel to a latitudinal axis of said container, said inner container having an open top end disposed subjacent to said flange portions such that said flange portions remain continuously positioned above said inner container;

means for dispensing beer from the keg;

means for securing the keg within said inner container;

a rectilinear and elongated axle having opposed end portions and being positioned in the bore, said end portions extending outwardly from the bore;

a drain cock directly conjoined to said rear section and in fluid communication therewith such that excess fluid can be manually and selectively drained from said outer container, said drain cock being manually adaptable between open and closed positions; and a plurality of wheels directly and rotatably conjoined to said end portions of said axle, said wheels including a plurality of coextensive and juxtaposed ridges for providing traction when a user traverses a ground surface;

wherein said securing means comprises a plurality of locking plates each having at least one aperture formed therethrough; and a plurality of fastening members removably and threadably securing said locking plates to said flange portions in such a manner that said locking plates remain spaced above said flange portions respectively;

wherein said locking plates linearly extend horizontally from said flange portions and engage an upper portion of the keg for maintaining the keg at a substantially stable position during operating conditions.

2. The container of claim 1, wherein said dispensing means comprises:

a cylinder containing a predetermined volume of pressurized carbon dioxide gas;

a tap for manually and selectively dispensing beer, said tap including a central body directly connected to said front section and a handle portion directly and pivotally connected to said body and extending vertically therefrom;

wherein a user pivots said handle portion forwardly to dispense beer and pivots said handle rearwardly to the vertical position when finished dispensing beer;

a first conduit directly and removably connected to said cylinder and in fluid communication with the keg such that carbon dioxide gas is caused to exit the cylinder and enter the keg when said handle portion is pivoted forwardly;

wherein said carbon dioxide gas adds carbonation to the beer;

a dual gauge regulator directly connected to said cylinder for displaying the carbon dioxide gas pressure and the amount of gas remaining in the cylinder; and a second conduit directly and removably connected to said body of said tap and in fluid communication with the keg;

wherein the beer is caused to exit the keg and is channeled through said second conduit, the beer exiting said container via said tap when said handle portion is pivoted forwardly.

3. The container of claim 1, wherein said bottom section of said outer container further includes a monolithically formed leg portion extending downward and orthogonal from said bottom section of said outer container, said leg portion providing support and stability when said container is at rest, said outer container being pivotal about a latitudinal axis such that said leg portion is elevated from a ground surface during transportation of said container.

4. The container of claim 1, wherein said lid includes a notch centrally formed therein, the notch including a lip portion extending to a point medial of the notch, said lip portion being grasped by a user during operating conditions to assist in removing and replacing said lid during cleaning procedures.

5. The container of claim 1, wherein said front section has a laterally offset and monolithically formed upper portion such that said tap can readily dispense beer into a vessel positioned therebelow.

* * * * *